US011358792B2

(12) United States Patent
Rimsa

(10) Patent No.: US 11,358,792 B2
(45) Date of Patent: Jun. 14, 2022

(54) CART WASHER LIFTER

(71) Applicant: Perkins Manufacturing Co., Bolingbrook, IL (US)

(72) Inventor: James Rimsa, Joliet, IL (US)

(73) Assignee: PERKINS MANUFACTURING CO., Bolingbrook, IL (US)

( * ) Notice: Subject to any disclaimer, the term of this patent is extended or adjusted under 35 U.S.C. 154(b) by 0 days.

(21) Appl. No.: 17/146,698

(22) Filed: Jan. 12, 2021

(65) Prior Publication Data

US 2021/0221609 A1 Jul. 22, 2021

Related U.S. Application Data

(60) Provisional application No. 62/963,382, filed on Jan. 20, 2020.

(51) Int. Cl.
*B65F 1/14* (2006.01)
*B65F 7/00* (2006.01)
(Continued)

(52) U.S. Cl.
CPC ..... *B65F 1/1452* (2013.01); *B08B 9/0826* (2013.01); *B08B 9/093* (2013.01); *B65F 7/005* (2013.01)

(58) Field of Classification Search
CPC ..... B65F 3/045; B65F 3/046; B65F 7/005; B65F 1/1452; B08B 9/0826
See application file for complete search history.

(56) References Cited

U.S. PATENT DOCUMENTS 3,291,144 A 12/1966 Diamond
3,372,875 A 3/1968 Torrey
(Continued)

FOREIGN PATENT DOCUMENTS

DE 2736208 A1 9/1978
DE 2901599 C2 7/1980
(Continued)

OTHER PUBLICATIONS

Presswire; The Trash Bin Cleaners Now Providing Innovative Cleaning Solution Services in Marin County; https://dialog.proquest.com/professional/docview/2172479971/16DA2921B9564F10B55/16?accountid=157282 ; Jan. 29, 2019; (3pgs).

*Primary Examiner* — Kaitlin S Joerger
(74) *Attorney, Agent, or Firm* — Cook Alex Ltd.

(57) ABSTRACT

A refuse container lifter is provided that comprises a base, a cross member, and first and second side plates; first and second masts connected on a first end to the first and second side plates, respectively; a first piston/cylinder actuator having first and second ends associated with each of the first and second masts for moving the masts between first and second positions; a cross bar rotatably mounted between the first and second masts at the second end of each mast and having a crank arm associated therewith; a second piston/cylinder actuator having first and second ends associated with each of the first and second masts for rotating the cross bar; first and second spaced-apart forks rigidly mounted to the cross bar and configured to be received in fork pockets of commercial refuse collection containers; and a residential refuse cart lifter secured to the cross member of the base at a position intermediate the first and second forks.

6 Claims, 15 Drawing Sheets

(51) Int. Cl.
*B08B 9/093* (2006.01)
*B08B 9/08* (2006.01)

(56) References Cited

U.S. PATENT DOCUMENTS

| | | | | |
|---|---|---|---|---|
| 3,604,577 | A | 9/1971 | Heilmeler | |
| 3,881,950 | A | 5/1975 | Pettit | |
| 4,239,437 | A * | 12/1980 | Naab | B65F 3/046 414/408 |
| 4,694,846 | A | 9/1987 | Bouchard | |
| 6,224,317 | B1 * | 5/2001 | Kann | B65F 3/041 414/408 |
| 6,554,008 | B2 | 4/2003 | Dewey et al. | |
| 7,390,159 | B2 * | 6/2008 | Rimsa | B65F 3/046 414/408 |
| 10,661,317 | B1 * | 5/2020 | Conway | B08B 9/0826 |
| 10,864,561 | B2 * | 12/2020 | Conway | B08B 9/0936 |
| 10,926,949 | B2 * | 2/2021 | Conway | B65F 3/041 |
| 11,130,629 | B1 * | 9/2021 | Vaselaar | B65F 3/046 |
| 2001/0046430 | A1 | 11/2001 | Bayne | |
| 2005/0095097 | A1 | 5/2005 | Arrez et al. | |
| 2008/0089764 | A1 | 4/2008 | Vistro | |
| 2008/0289665 | A1 | 11/2008 | Dwyer | |
| 2010/0170537 | A1 | 7/2010 | Gingras | |
| 2012/0125364 | A1 | 5/2012 | Wiley et al. | |
| 2014/0144470 | A1 | 5/2014 | Sewell et al. | |
| 2021/0008608 | A1 * | 1/2021 | Conway | B65F 7/005 |
| 2021/0221609 | A1 * | 7/2021 | Rimsa | B08B 9/0826 |

FOREIGN PATENT DOCUMENTS

| | | | |
|---|---|---|---|
| DE | 19920210 | A1 | 11/2000 |
| DE | 202007011448 | U1 | 11/2007 |
| EP | 0137416 | A2 | 4/1985 |
| NL | 1009880 | | 2/2000 |
| WO | 2006117103 | A1 | 11/2006 |

* cited by examiner

CART WASHER LIFTER

BACKGROUND

Systems and methods for cleaning refuse collection containers are known in which spray nozzles are combined with a cart lifter. The cart lifter inverts the collection container to a position where the spray nozzles are aimed at the inside of the cart. After the inside of the container is washed out, the cart lifter returns the collection cart to its original, upright position. See, e.g., U.S. Pat. No. 6,554,008, EP 0 137 416, and U.S. Pat. No. 3,291,144, which are incorporated herein by reference.

By way of the present application, a container lifter for a refuse collection cart washer is provided that can be used for washing both large, commercial refuse collection containers and residential refuse collection carts.

SUMMARY

The present application has several aspects. In a first aspect, a refuse container lifter is provided that comprises a base having first and second upright members, a cross member supported between the upright members, and first and second side plates respectively associated with the first and second upright members; first and second masts, each having a first end and a second end, pivotally connected on its first end to the first and second side plates, respectively, of the base; a first piston/cylinder actuator having first and second ends associated with each of the first and second masts, the first piston/cylinder actuator being pivotally connected on the first end to the side plate at a position spaced from the pivot connection of the mast to the side plate and pivotally connected on the second end to the second end of the mast for moving the masts between first and second positions; a cross bar rotatably mounted between the first and second masts at the second end of each mast and having a crank arm associated with each end; a second piston/cylinder actuator having first and second ends associated with each of the first and second masts, the second piston/cylinder actuator being pivotally connected on its first end to the first end of its respective mast and on its second end to the crank arm associated with the cross bar for rotating the cross bar; first and second spaced-apart forks rigidly mounted to the cross bar and configured to be received in fork pockets of commercial refuse collection containers; and a residential refuse cart lifter secured to the cross member of the base at a position intermediate the first and second forks; the residential refuse cart lifter comprising a bracket mounted to the cross member, and actuator mounted to the bracket, first and second lift arms each having first and second ends, with the first end of each lift arm mounted to the actuator, first and second follower arms each having first and second ends, the first end of each follower arm pivotally mounted to the bracket, and a cart grabber assembly pivotally secured to the second ends of both the lift arms and follower arms, the lift arms moveable by the actuator between a first upright position and a second inverted position; wherein the lift arms and follower arms are configured so that when the masts are in the first position and the lift arms are in the first upright position, the cart grabber is spaced rearwardly from and below the cross bar, and when the masts are in the second inverted position, and the lift arms are moved to the second inverted position, the cart grabber is spaced rearwardly from and above the cross bar.

In a second aspect, the lift arms and the follower arms each have a generally J-shaped configuration, with an elongated first portion that is connected to the actuator for the lift arms and to the base member for the follower arms, and a second, shorter portion disposed and an angle from the first portion that is pivotally secured to the cart grabber mechanism.

In a third aspect, the first portion of each of the lift and idler arms has a length so that, when the masts are in the first position and the lift arms are in the first upright position, the cart grabber is spaced rearwardly from and below the cross bar, and when the masts are in the second position, and the lift arms are moved to the second inverted position, the cart grabber is spaced rearwardly from and above the cross bar, with the cross bar member being positioned roughly at a center point of a bend between the first and second portions of the lift arms and the follower arms.

In a fourth aspect, the refuse container lifter further comprises a spacer block associated with the cross bar for maintaining a space between the cross bar and a commercial refuse collection container carried on the forks.

In a fifth aspect, a spacer block is associated with each fork.

In a sixth aspect, each crank arm is secured to a respective fork.

DESCRIPTION

Figure 1:
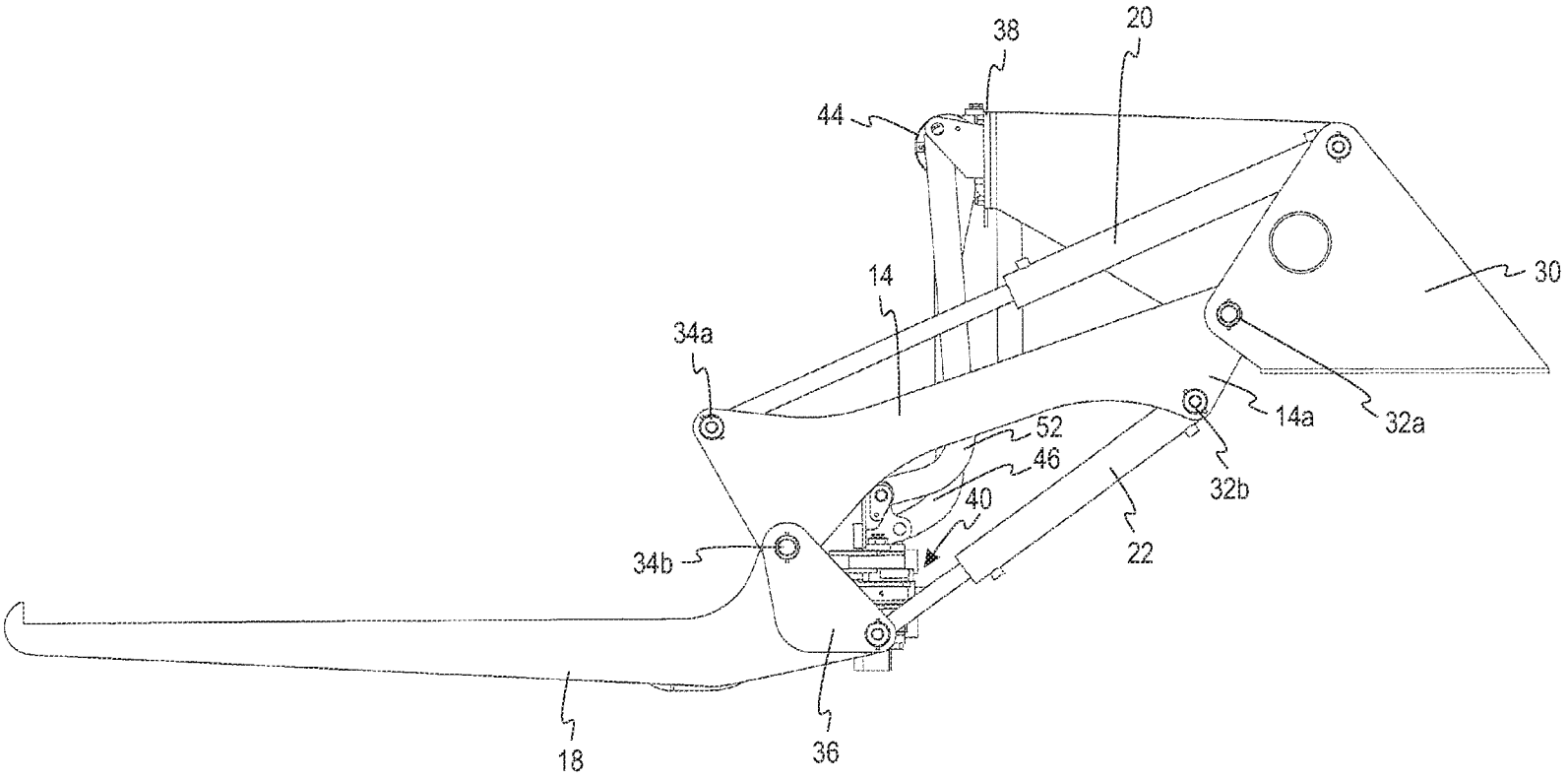
FIG. 1 is a side view of a cart lifter according to the present disclosure configured for lifting both a commercial refuse collection container and a residential collection cart, with the forks in a lowered pick-up position, where it can pick up the lowest commercial bins.
Figure 2:
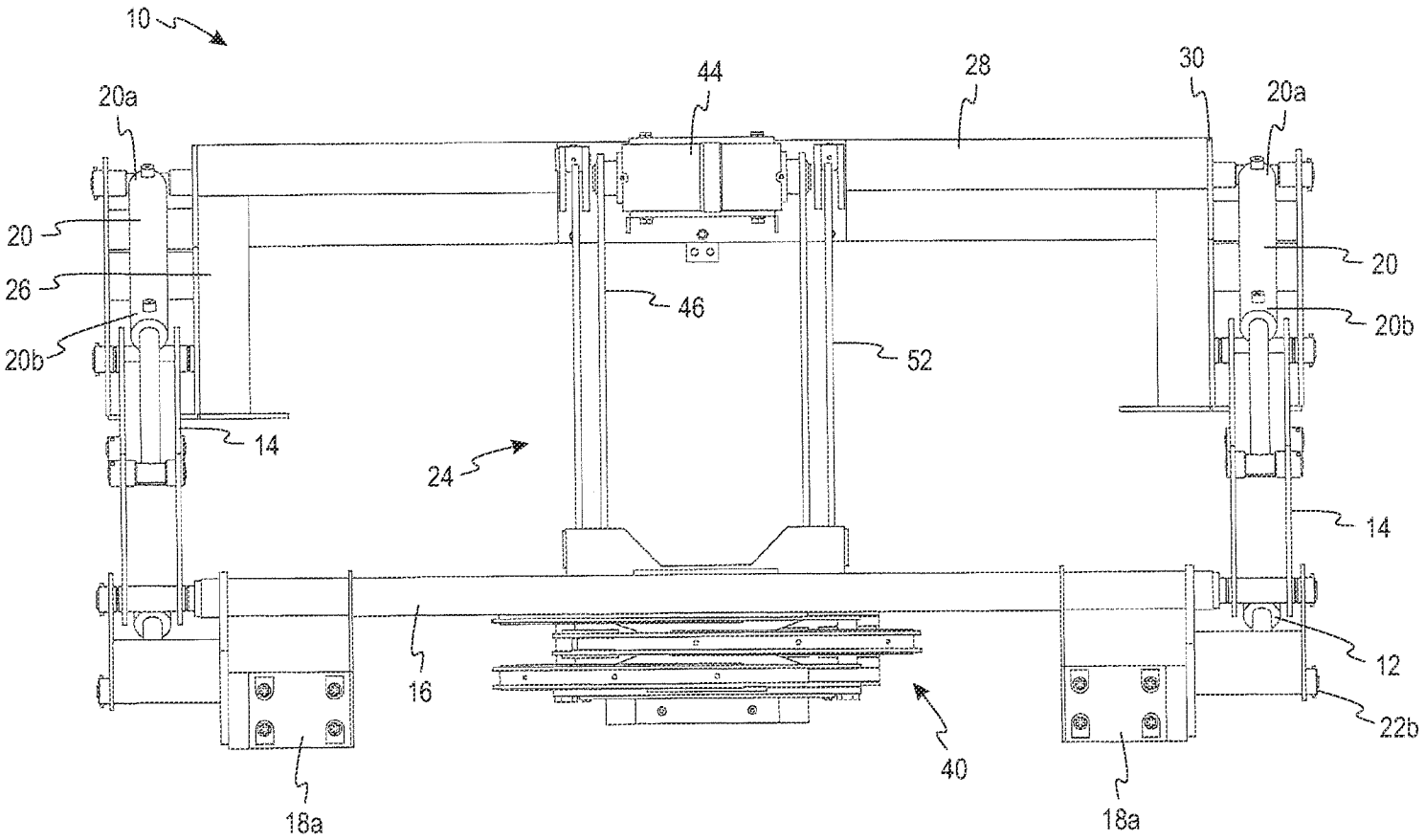
FIG. 2 is a front view of the cart lifter in the position shown in FIG. 1.
Figure 3:
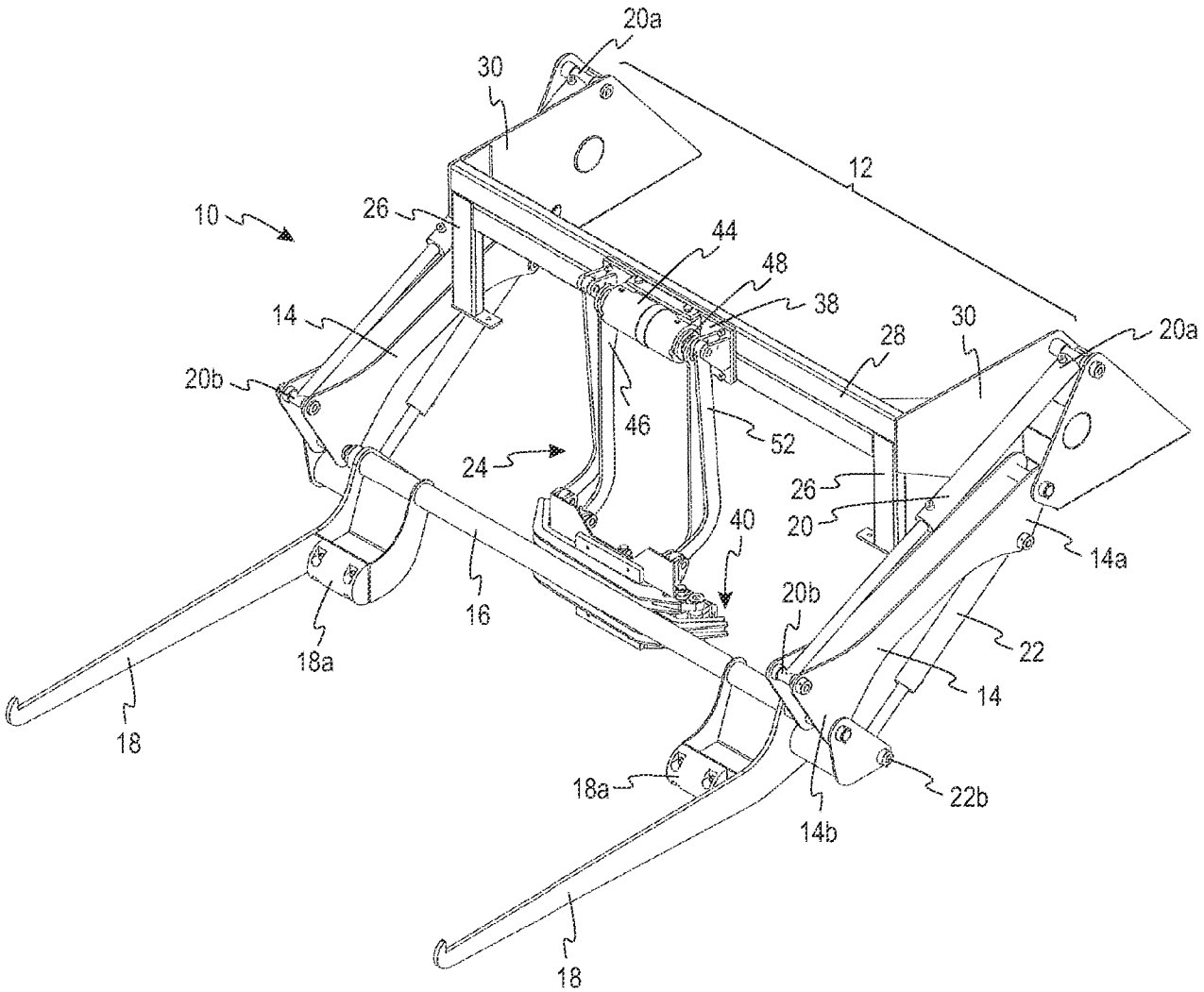
FIG. 3 is a perspective view of the cart lifter in the position shown in FIG. 1.
Figure 4:
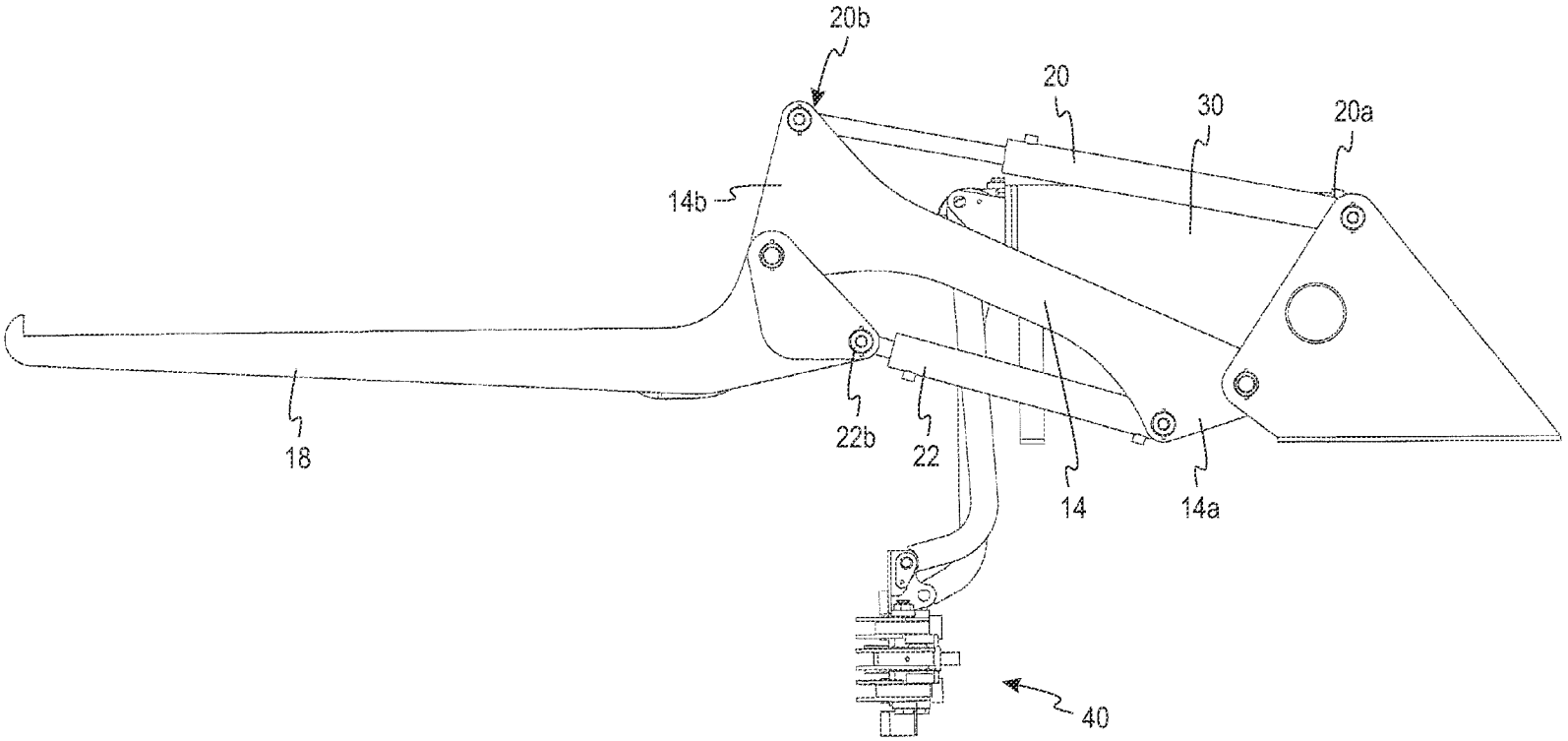
FIG. 4 is a side view of the cart lifter of FIG. 1 with the forks in an intermediate corresponding to the highest point at which the forks can still engage a commercial refuse collection container.
Figure 5:
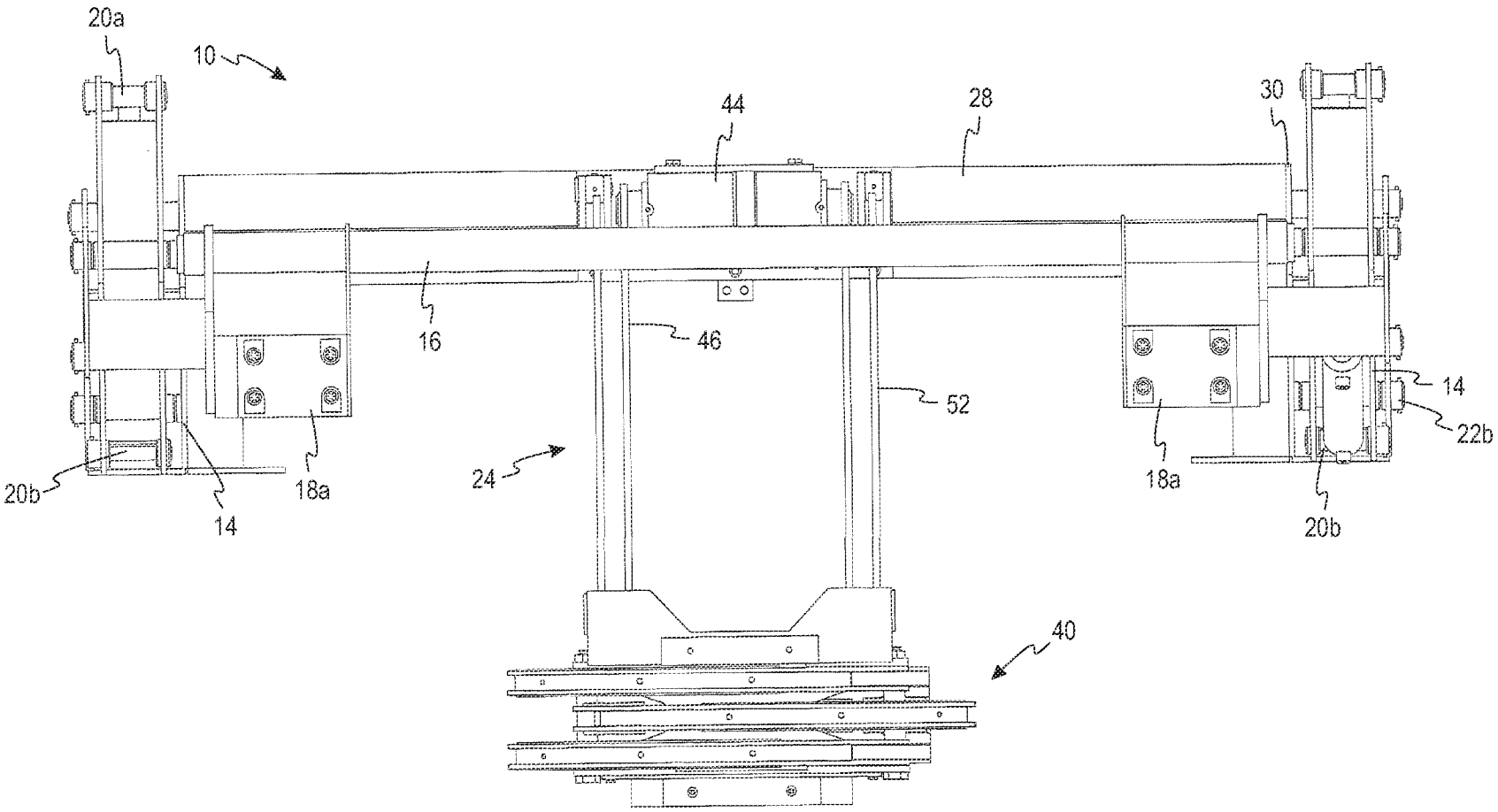
FIG. 5 is a front view of the cart lifter in the position shown in FIG. 4.
Figure 6:
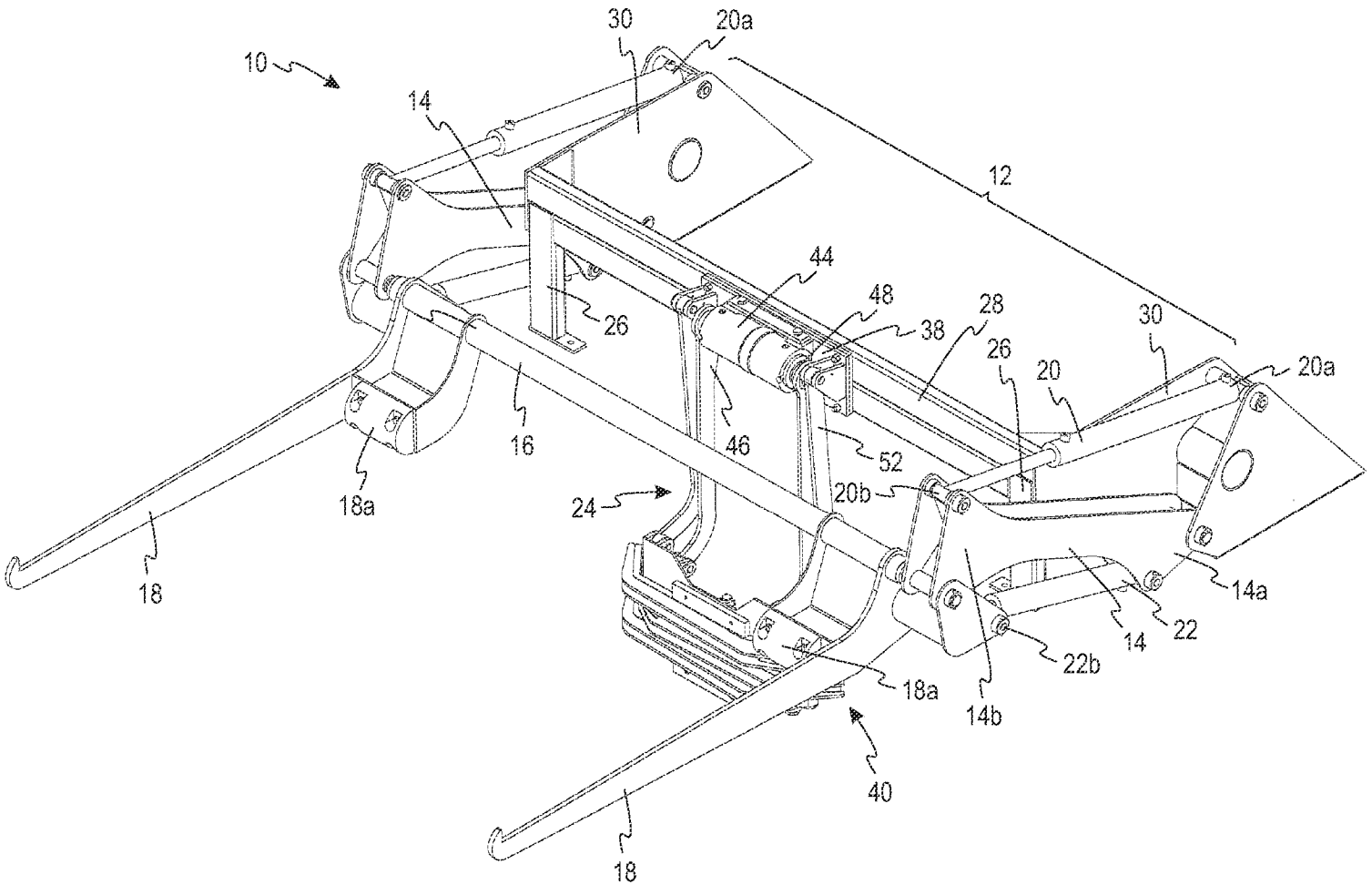
FIG. 6 is a perspective view of the cart lifter in the position shown in FIG. 4.
Figure 7:
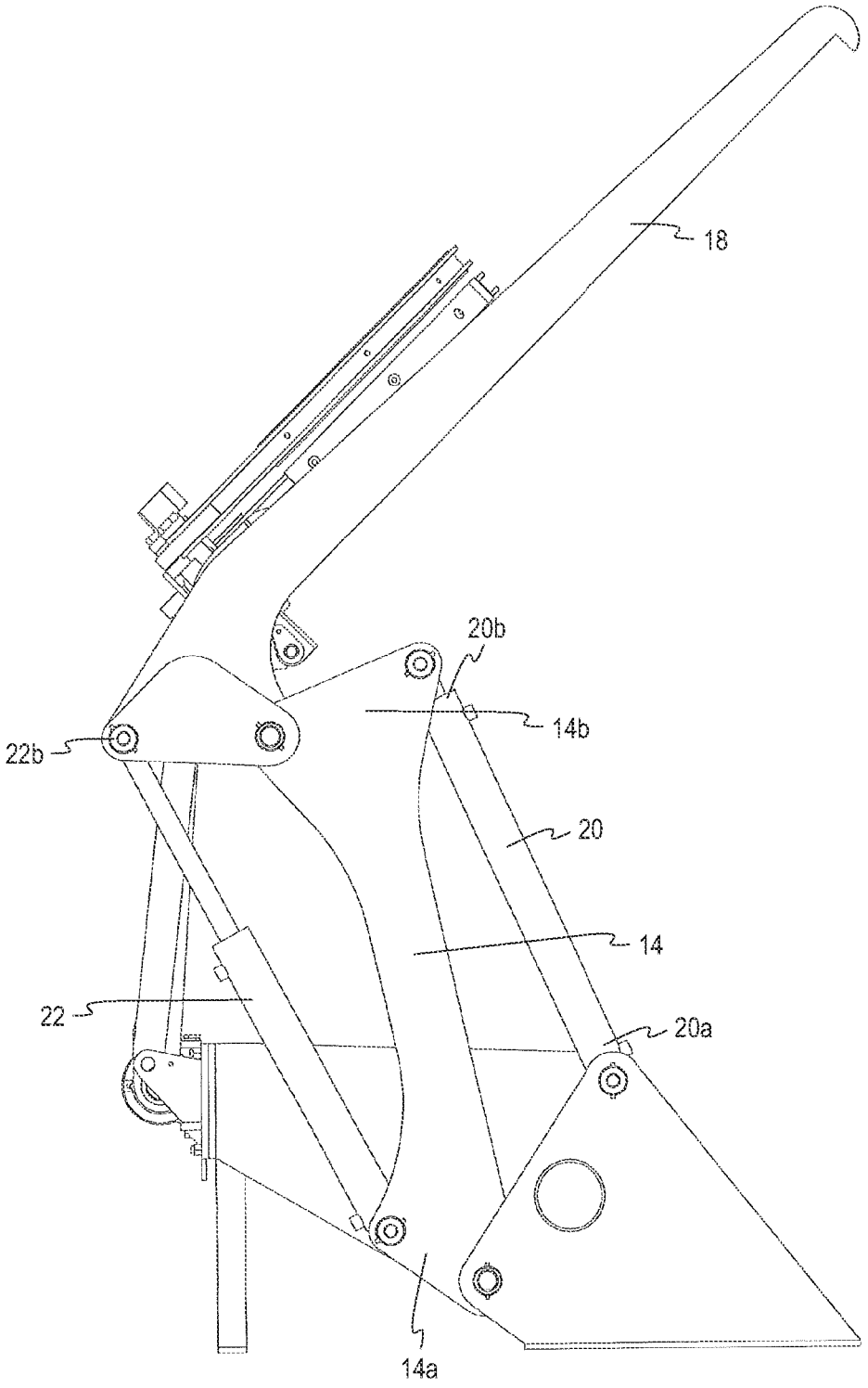
FIG. 7 is a side view of the cart lifter of FIG. 1 with the mast raised fully and the forks tilted for washing a commercial refuse collection container, and the associated residential cart lifter also inverted for washing a residential refuse collection cart.
Figure 8:
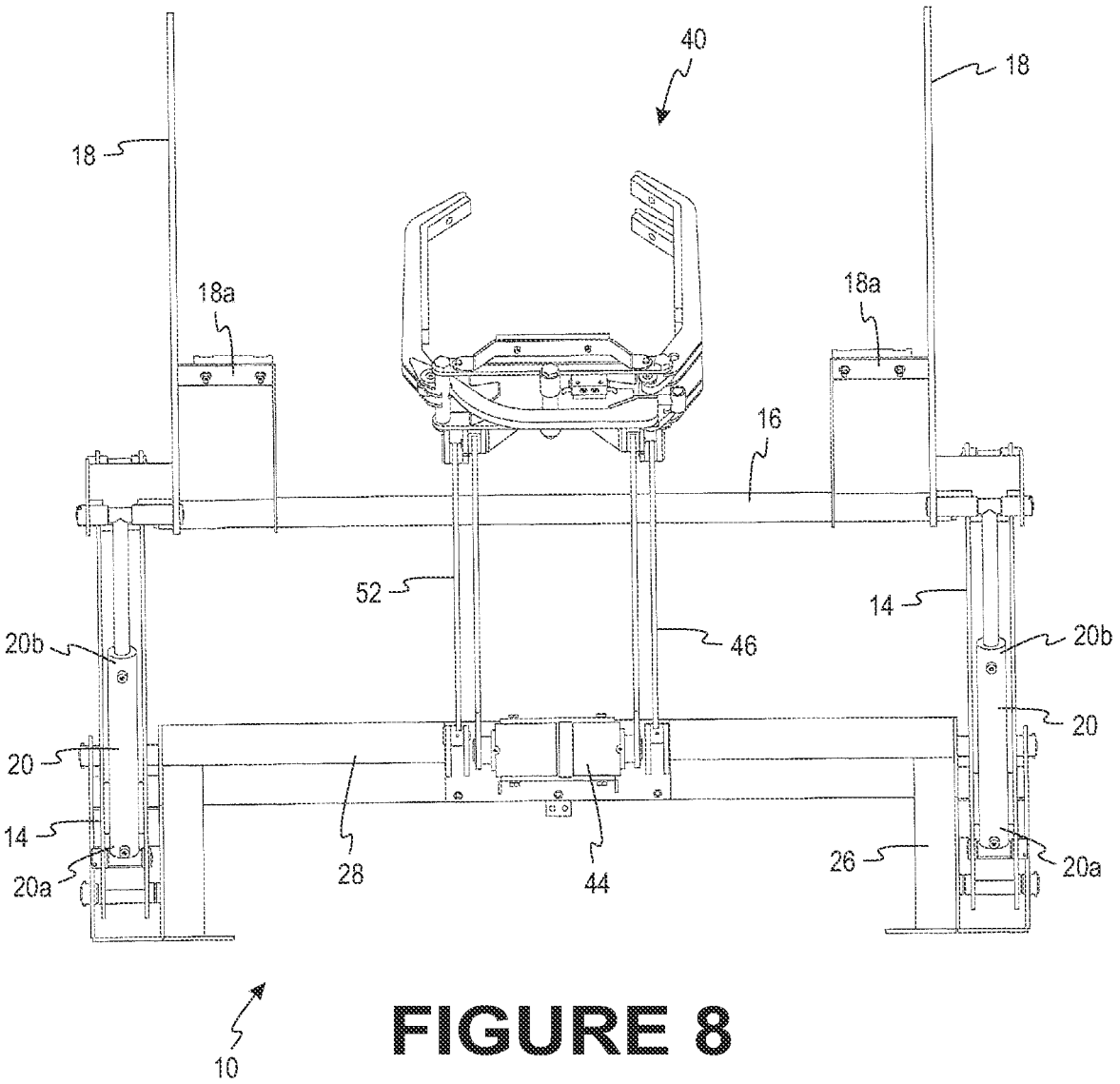
FIG. 8 is a front view of the cart lifter in the position shown in FIG. 7.
Figure 9:
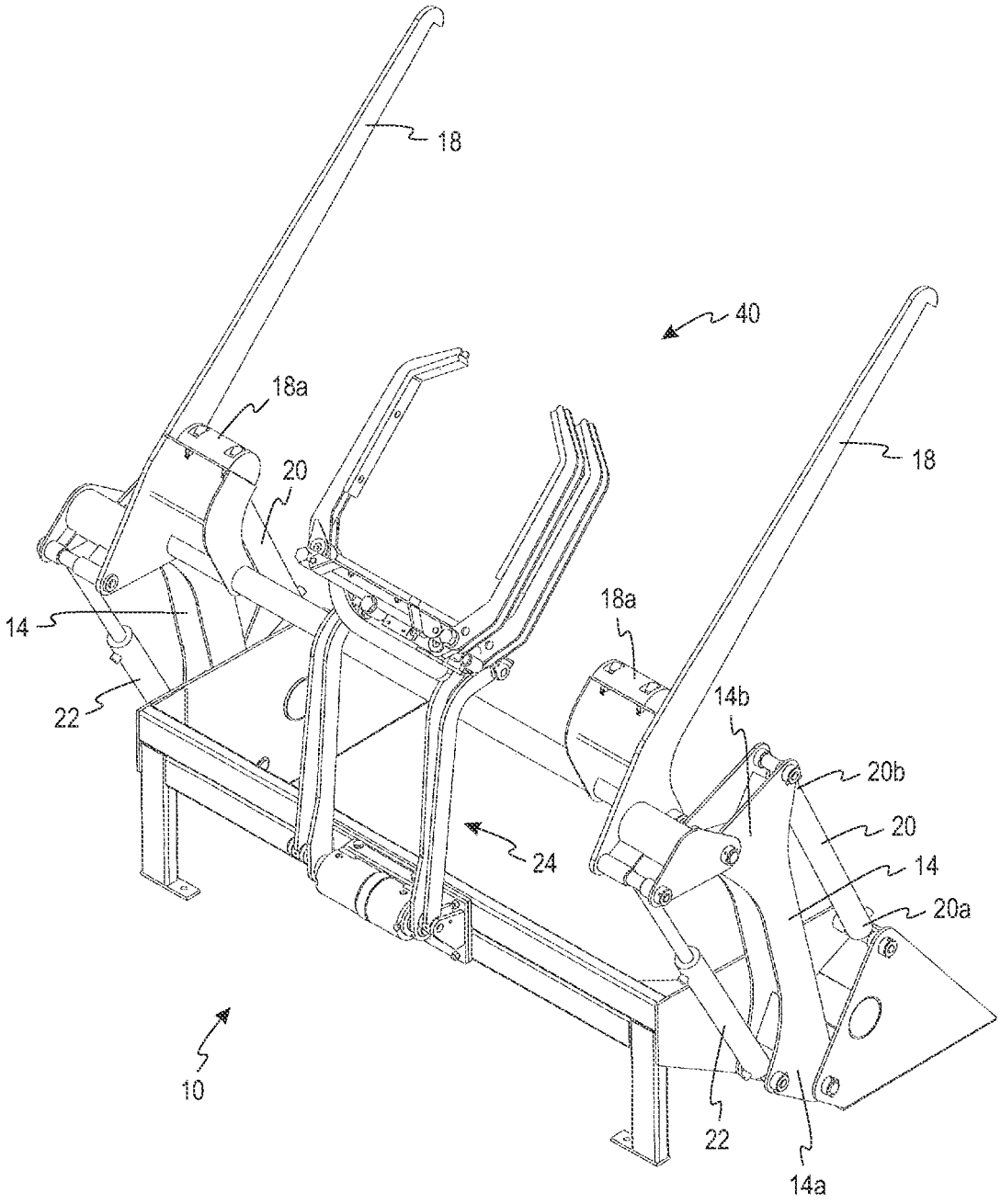
FIG. 9 is a perspective view of the cart lifter in the position shown in FIG. 7.

In accordance with the present disclosure, a cart lifter is provided that is mountable to the rear of a trailer or truck and is suited for use with both commercial-sized refuse collection containers (typically 1-8 cubic yards in size), designed to be used with lifters having lift forks, and residential refuse collection carts (typically 35-96 gallons in size) that are not liftable by lifters having forks. Specifically, the lifter combines a cart lifter configured for lifting a commercial refuse collection container with residential refuse cart lifter, thus permitting the lifter to be used in servicing both commercial and residential refuse collection routes.

In general, the cart lifter, generally designated 10, comprises a stationary frame or base 12 to which are pivotally attached a pair of masts 14. A rigid cross bar 16 interconnects the free ends of the masts 14. A pair of forks 18 are rigidly secured to the cross bar 16 and are spaced apart a distance sufficient to be inserted into the fork sleeves of a commercial refuse collection container. Preferably, each fork 18 has an associated spacer block 18*a* for spacing a commercial refuse collection container from the cross bar 16 when carried on the forks 18. A first pair of hydraulic piston/cylinders 20 is provided for raising and lowering the masts, while a second pair of piston/cylinders 22 is provided for rotating the cross bar 16 to tilt the forks 18 relative to the masts 14. One or more residential cart lifters 24 are mounted to the frame/base 12.

More specifically, the base 12 of the cart washer lifter 10 comprises an assembly having first and second upright members 26. A cross member 28 is supported between the upright members 26, and first and second side plates 30 are respectively associated with the first and second upright members 26.

The first and second masts 14 each have a first end 14*a* and a second end 14*b*. Each mast 14 is pivotally connected on its first end 14*a* to its respective side plate 30 of the base 12. As illustrated, the masts 14 have a "dog bone" configuration, with enlarged ends 14*a*, 14*b* and a narrower mid portion. As will be seen, the enlarged ends 14*a*, 14*b* permit spaced-apart pivot connections to be located on each end of the masts 14, with end 14*a* having spaced-apart pivot connections 32*a*, 32*b* and end 14*b* having spaced-apart pivot connections 34*a*, 34*b*.

Figure 10:
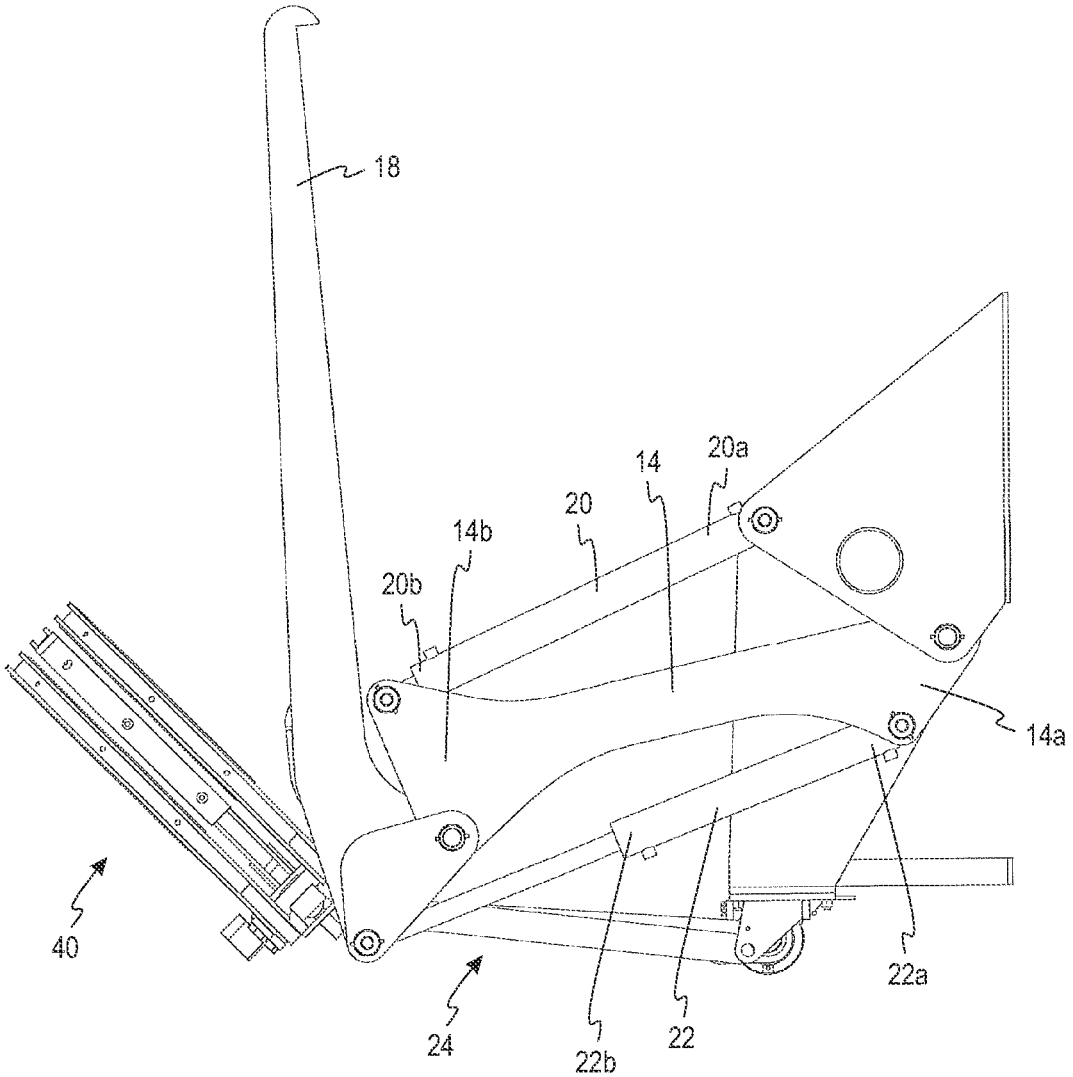
FIG. 10 is a side view of the cart lifter of FIG. 1 with the mast fully raised and the forks tilted further down, in a stowed position.

The first piston/cylinder actuator 20 is associated with each mast 14 for moving the masts 14 between a first, lower position (as seen in FIG. 1, for engaging and releasing a commercial refuse collection container), and a second, upper position (as seen in FIG. 10, for inverting a commercial refuse collection container for washing or for storage). Each of the first piston/cylinder actuators 20 has a first end 20*a* and a second end 20*b*, with each first piston/cylinder actuator 20 being connected on its first end 20*a* to the side plate 30 at pivot connection at a position spaced from the pivot connection 32*a* of the mast 14 to the side plate 30, and connected on its second end 20*b* to the pivot connection 32*b* of the second end 14*b* of the mast 14.

The cross bar 16 is rotatably mounted between the first and second masts 14 at the second end 14*b* of each mast 14, with a crank arm 36 being secured to each end of the cross bar 16. The second piston/cylinder actuator 22 for rotating the cross bar 16 is associated with each of the first and second masts 14. Each second piston/cylinder actuator 22 has first end 22*a* and a second end 22*b*, and each is pivotally connected on its first end 22*a* to the first end 14*a* of its respective mast 14 and on its second end 22*b* to the crank arm 36 associated with the cross bar 16. As noted above, the first and second spaced-apart forks 18, which are configured to be received in fork pockets of commercial refuse collection containers, are rigidly mounted to the cross bar 16.

The residential refuse cart lifter 24 comprises a bracket 38 by which the cart lifter 24 is secured to the cross member 28 of the base 12 at a position intermediate the first and second forks 18. The general structure and operation of residential cart lifters is well known, as seen in e.g., U.S. Pat. No. 7,390,159, and US 2005/0095097, each of which is assigned to the assignee of the present application and is incorporated herein by reference.

Figure 12:
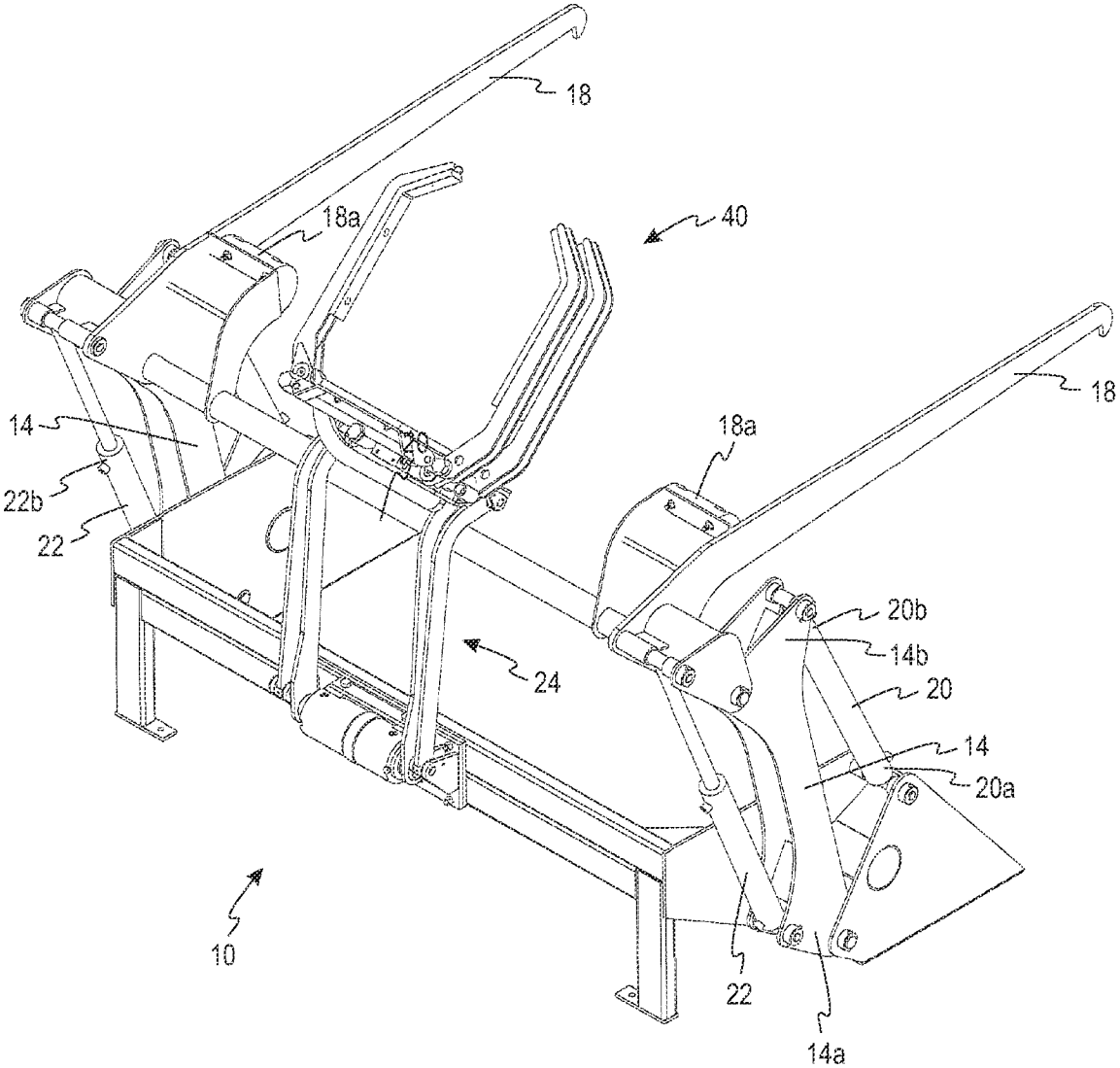
FIG. 12 is a perspective view of the cart lifter in the position shown in FIG. 10, with the forks in a stowed position.

The residential refuse cart lifter further comprises a cart grabber assembly, generally designated 40, for holding and releasing a residential refuse collection container (such as cart 42, seen in FIGS. 13 and 14), and a rotary actuator 44 that is supported in the bracket 38 for moving the grabber assembly 40 between a first, upright position (as seen in FIG. 1, for grabbing and releasing a residential refuse collection container) and a second, inverted position (as seen in FIG. 12, for washing the interior of the collection container and for storing the residential cart lifter between uses). More specifically, and with reference to FIGS. 15*a*, 15*b*, the grabber assembly is operatively connected to the rotary actuator 44 by a pair of lift/drive arms 46 each having a first end 46*a* secured to the shaft 48 of the rotary actuator 44 and pivotally secured on a second end 46*b* to the carriage 50 for the grabber assembly 40. A pair of idler/follower arms 52 is pivotally mounted on a first end 52*a* to the bracket 38 for the rotary actuator 44 so as to be outboard of the lift/drive arms 46 and pivotally secured on a second end 52*b* to the carriage 50 for the grabber assembly 40 so as to rotate the carriage 50 as it moves between the first and second positions.

As can be appreciated, the cart washer lifter 10 must be configured so that the operations of the commercial container lifter and residential cart lifter 24 do not interfere with one another. In order to achieve this, the pivot point geometry and length of the masts 14 are selected to permit the combination of a commercial lifter and residential lifter 24. The cylinder pivot points are placed strategically to allow for them to act as both actuator and stabilizer for when the other cylinder is functioning. Thus, when the cross bar 14 supporting the forks 18 is down, the residential lifter 24 is positioned behind it. When the forks 18 are up, the residential lifter 24 inverts the container 42 over the cross bar 16.

Figure 11:
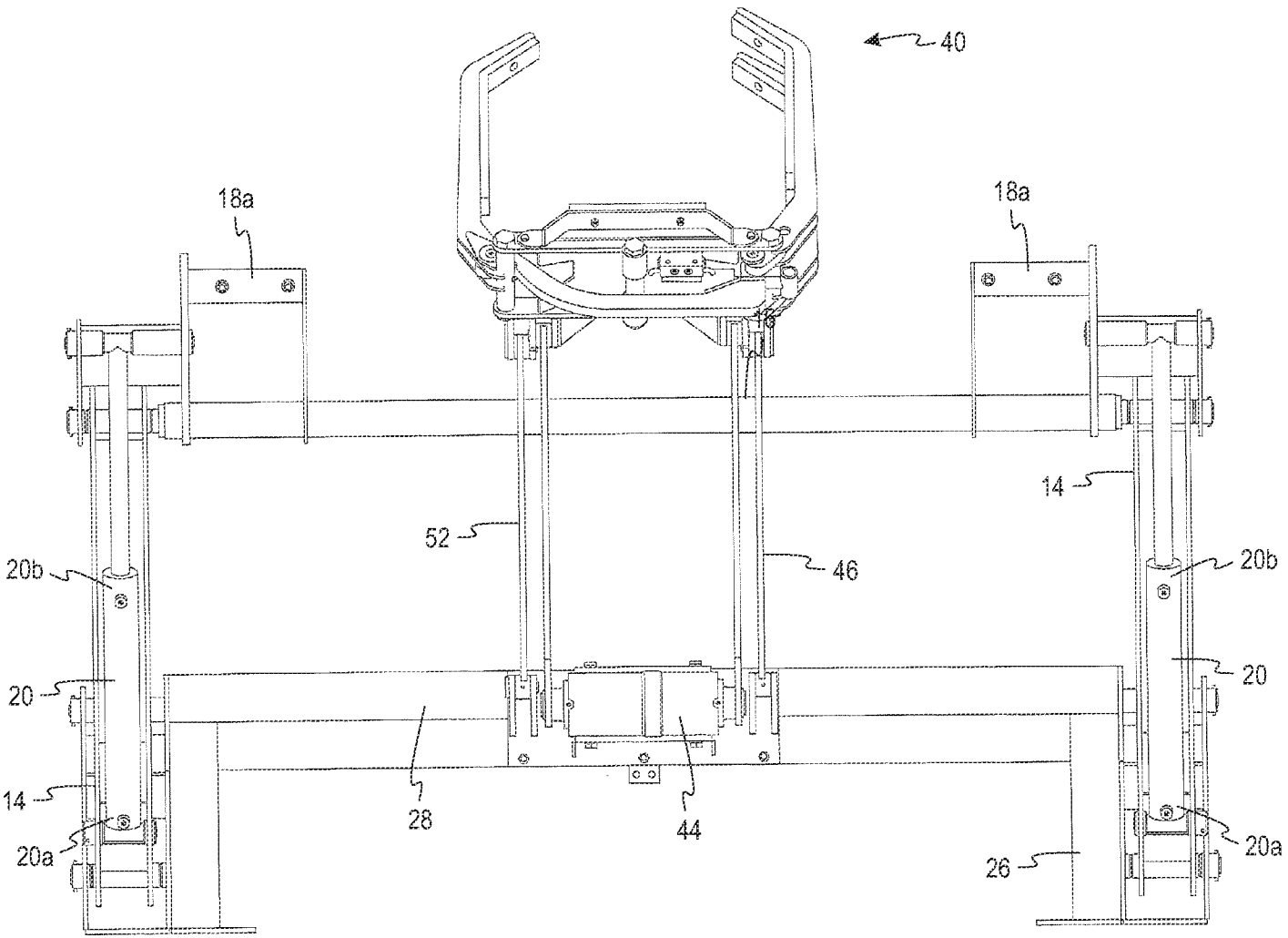
FIG. 11 is a front view of the cart lifter in the position shown in FIG. 10, with the forks in a stowed position.
Figure 13:
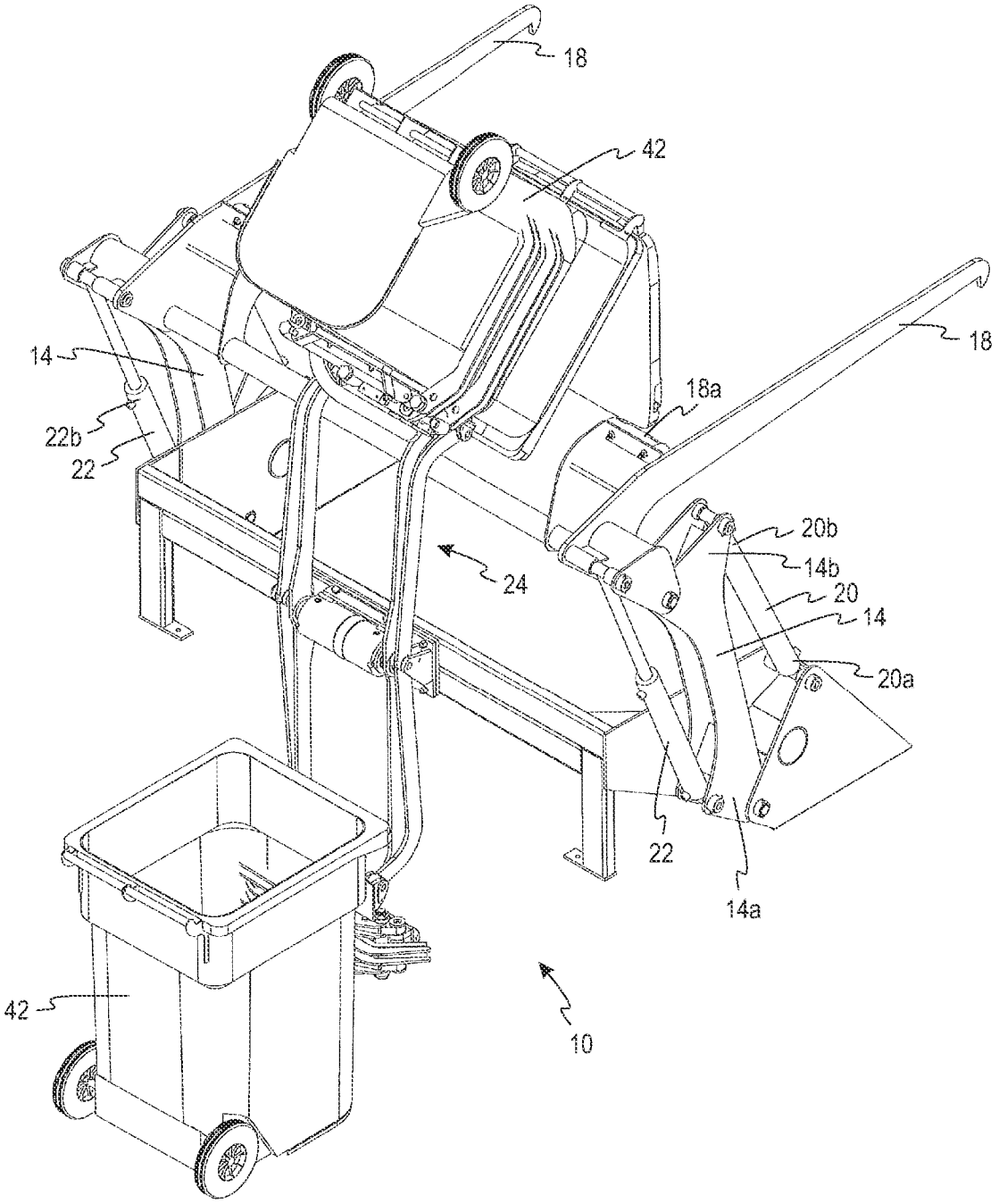
FIG. 13 is a perspective view of a cart washer lifter according to the present disclosure in combination with a residential refuse collection cart, with the forks in the position shown in FIG. 12, and the residential collection cart lifter in the initial/storage position and the second inverted position.
Figure 14:
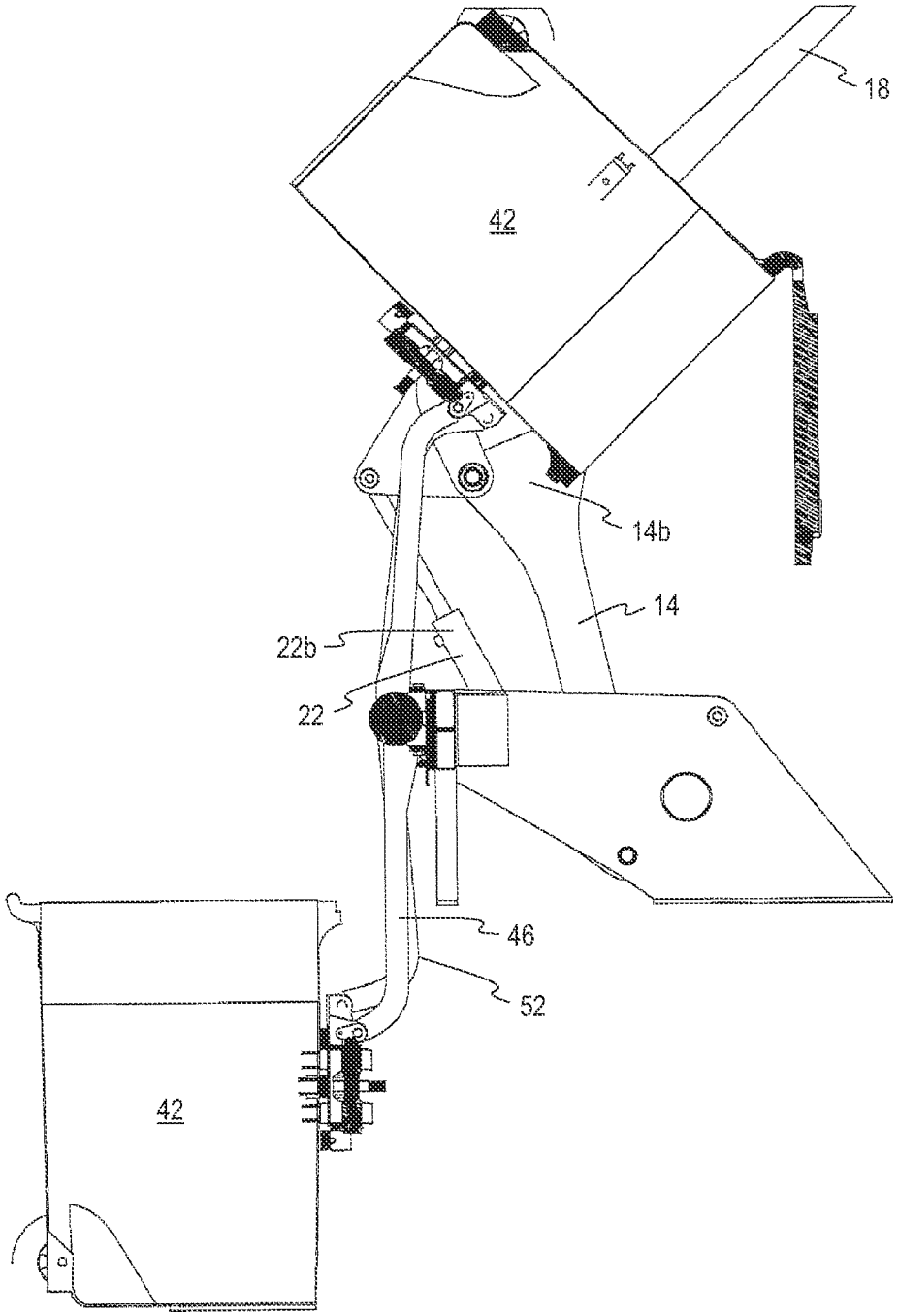
FIG. 14 is a side view of the cart washer lifter/residential refuse collection cart of FIG. 13.
Figure 15B:
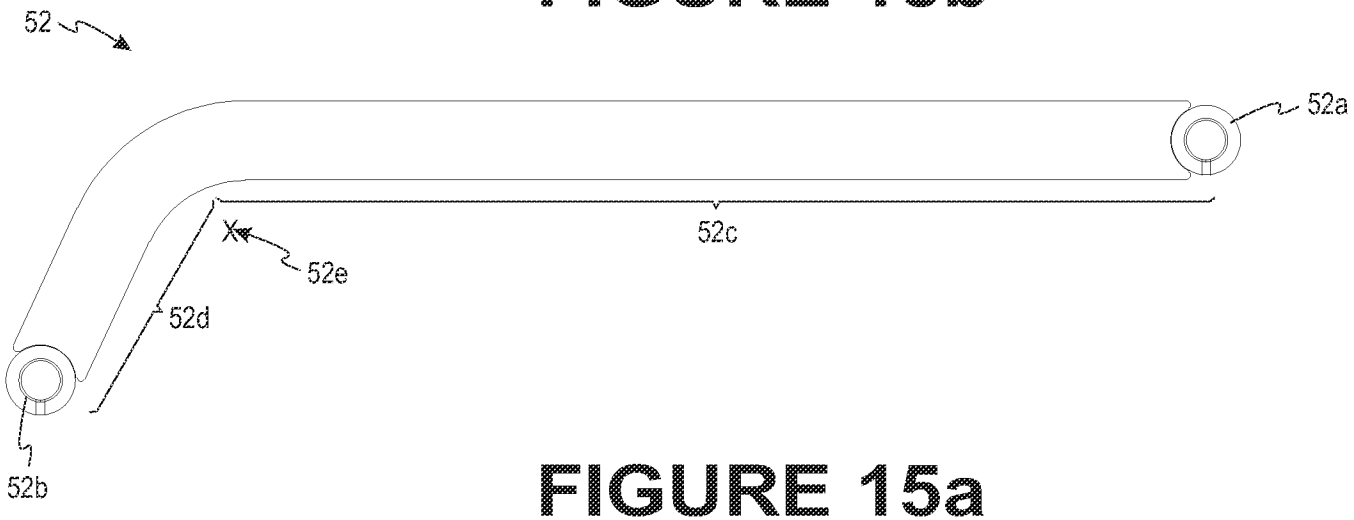
FIGS. 15*a* and 15*b* are plan views of the driver arm and idler arm, respectively, of the residential collection cart lifter.
Figure 15A:
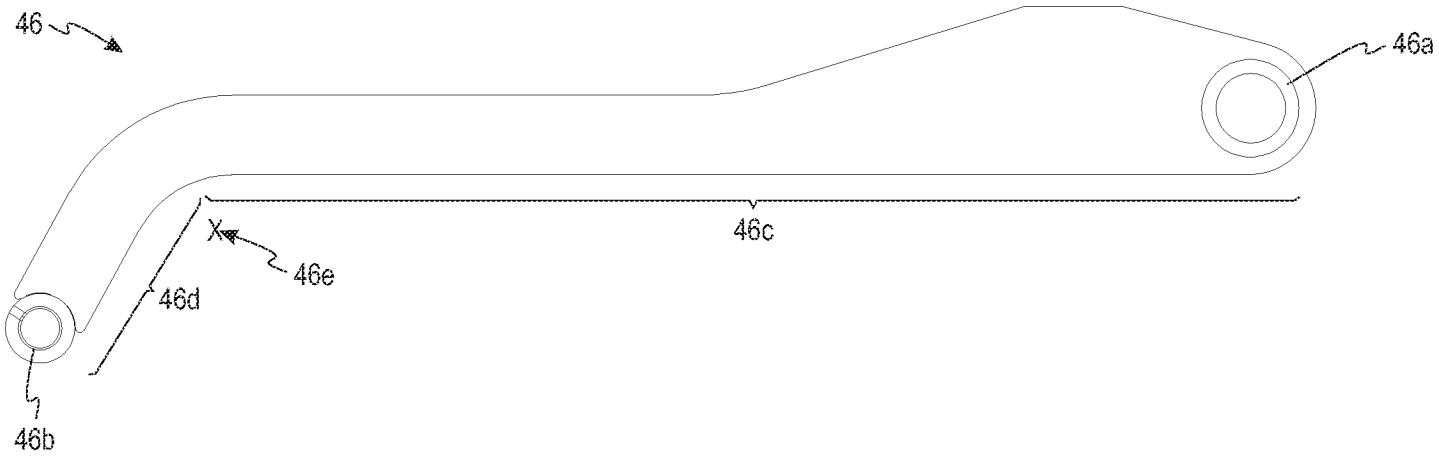

With reference to the drawings, the lift/drive arms 46 and idler/follower arms 52 of the residential cart lifter 24 are sized so that the grabber assembly 40 clears the cross bar 16 when it is in the second inverted position. Thus, with the forks 18 stowed upwards, folded down low, as shown in FIG. 11, the residential cart lifter 24 is free to operate by inverting a residential refuse cart 42 over the cross bar 16 of the fork assembly, as shown in FIGS. 13 and 14, without the operator having to move the forks 18 out of the way. Further, when the forks 18 are down, the residential cart lifter 24 is neatly packed away behind the cross bar 16, and does not interfere with the fork/bar operation.

In one embodiment, the lift/drive arms 46 and idler/follower arms 52 of the residential refuse cart lifter each have a dog-leg or J-shaped configuration (best seen in FIGS. 15*a*, 15*b*), with an elongated first portion (46*c* or 52*c*) that is connected to the rotary shaft 48 of the actuator 44 (for the lift/drive arms 46) or to the bracket member 38 (for the idler/follower arms 52), and a second, shorter portion (45*d* or 52*d*) disposed at an angle from the first portion that is pivotally secured to the carriage 50 for the cart grabber mechanism 50. The first portion has a length so that, when the masts 14 are in the first position and the lift arms 46 of the residential cart lifter 24 are in the first/upright position (as seen in FIG. 1), the cart grabber 40 is spaced rearwardly from and below the cross bar 16, and when the masts 14 are in the second position, and the lift arms 46 of the residential cart lifter 24 are moved between the first/storage position and the second inverted position (as seen in FIGS. 12 and 13), the cart grabber 40 is spaced rearwardly from and above the cross bar 16, with the cross bar 16 being positioned roughly at the center point (46*e* or 52*e*) of the bend between the first and second portions of the lift/drive arms 46 and the idler/follower arms 52. This permits the residential cart lifter 24 to move without interference with the commercial cart lifter when the commercial cart lifter in in the second position. Further the length of the masts 14 is such that the cross bar 16 of the commercial cart lifter is spaced in front of the folded grabber arms of the residential cart lifter 24 when the residential cart lifter 24 is in the first/storage position and the commercial cart lifter is in the lowered position for engagement with a commercial collection container.

A cart washer lifter according to the present disclosure has several advantages over previously-available cart washer lifters. For example, the left-hand and right-hand forks are physically linked together so they cannot get out of sync with each other; the forks are able to tilt down when in a storage position, so they are less likely to hit low-hanging obstacles as the operator drives the vehicle; the pickup range between the lowest and highest point is sufficiently large to permit use with a wide range of styles of commercial refuse collection containers; the cart lifter is relatively light in weight, simple in design, and economical in manufacture; there are no sliding members, resulting in less maintenance; because the forks rotate, and not slide, the forks can achieve different angles that a sliding system cannot, which can help engage bins that might be on a slope or uneven surface relative to the service vehicle; the ability to angle the forks also helps with washing, by being able to position different shaped bins at the angle most suitable for that shape; and the residential lifter is capable of dumping over the fork bar while the unit is in the elevated position, saving time when servicing a residential refuse collection container because the forks can stay in the stowed position.

Thus, a refuse collection cart lifter for a cart washer has been provided that may be used for washing both large, commercial refuse collection containers and residential refuse collection carts. While the cart lifter has been described in terms of a preferred embodiment, the invention should not be limited to the same, but also include changes that would be readily apparent to one skilled in the art, within the scope of the following claims.

The invention claimed is:

1. A refuse container lifter comprising:

a) a base having first and second upright members, a cross member supported between the upright members, and first and second side plates respectively associated with the first and second upright members;

b) first and second masts, each having a first end and a second end, pivotally connected on its first end to the first and second side plates, respectively, of the base;

c) a first piston/cylinder actuator having first and second ends associated with each of the first and second masts, the first piston/cylinder actuator being pivotally connected on the first end to the side plate at a position spaced from the pivot connection of the mast to the side plate and pivotally connected on the second end to the second end of the mast for moving the masts between first and second positions;

d) a cross bar rotatably mounted between the first and second masts at the second end of each mast and having a crank arm associated with each end;

e) a second piston/cylinder actuator having first and second ends associated with each of the first and second masts, the second piston/cylinder actuator being pivotally connected on its first end to the first end of its respective mast and on its second end to the crank arm associated with the cross bar for rotating the cross bar;

f) first and second spaced-apart forks rigidly mounted to the cross bar and configured to be received in fork pockets of commercial refuse collection containers; and g) a residential refuse cart lifter secured to the cross member of the base at a position intermediate the first and second forks; the residential refuse cart lifter comprising a bracket mounted to the cross member, and actuator mounted to the bracket, first and second lift arms each having first and second ends, with the first end of each lift arm mounted to the actuator, first and second follower arms each having first and second ends, the first end of each follower arm pivotally mounted to the bracket, and a cart grabber assembly pivotally secured to the second ends of both the lift arms and follower arms, the lift arms moveable by the actuator between a first upright position and a second inverted position; wherein the lift arms and follower arms are configured so that when the masts are in the first position and the lift arms are in the first upright position, the cart grabber is spaced rearwardly from and below the cross bar, and when the masts are in the second inverted position, and the lift arms are moved to the second inverted position, the cart grabber is spaced rearwardly from and above the cross bar.

2. The refuse container lifter of claim 1 wherein the lift arms and the follower arms each have a generally J-shaped configuration, with an elongated first portion that is connected to the actuator for the lift arms and to the base member for the follower arms, and a second, shorter portion disposed and an angle from the first portion that is pivotally secured to the cart grabber mechanism.

3. The refuse container lifter of claim 2 wherein the first portion of each of the lift and follower arms has a length so that, when the masts are in the first position and the lift arms are in the first upright position, the cart grabber is spaced rearwardly from and below the cross bar, and when the masts are in the second position, and the lift arms are moved to the second inverted position, the cart grabber is spaced rearwardly from and above the cross bar, with the cross bar member being positioned roughly at a center point of a bend between the first and second portions of the lift arms and the follower arms.

4. The refuse container lifter of claim 1 further comprising a spacer block associated with the cross bar for maintaining a space between the cross bar and a commercial refuse collection container carried on the forks.

5. The refuse container lifter of claim 4 wherein a spacer block is associated with each fork.

6. The refuse container lifter of claim 1 wherein each crank arm is secured to a respective fork.

* * * * *